US005415454A

United States Patent [19]

Fu-Tsung

[11] Patent Number: 5,415,454

[45] Date of Patent: May 16, 1995

[54] PIECE OF MULT-PURPOSE FURNITURE

[76] Inventor: Chuo Fu-Tsung, No. 517, Sec. 1, Jong Iang Rd., Wu-Chi Town, Taichung Hsien, Taiwan, Prov. of China

[21] Appl. No.: 123,413

[22] Filed: Sep. 17, 1993

[51] Int. Cl.[6] ..... A47C 13/00

[52] U.S. Cl. ..... 297/3; 297/130; 297/174; 297/271; 297/440.1; 5/105; 5/107

[58] Field of Search ..... 297/118, 119, 133, 271, 297/272, 423.1, 440.14, 440.1, 440.15, 130, 1, 3, 174; 5/101, 105, 107

[56] References Cited

U.S. PATENT DOCUMENTS

| | | | |
|---|---|---|---|
| 55,401 | 6/1866 | Warren | 297/118 |
| 794,401 | 7/1905 | Mackey | 297/271 |
| 1,079,265 | 11/1913 | Raphael | 5/107 |
| 2,793,679 | 5/1957 | Layne | 297/130 |
| 2,968,338 | 1/1961 | Reese | 297/440.15 |
| 3,233,942 | 2/1966 | Creutz | 297/118 |
| 3,556,586 | 1/1971 | Beardmore | 297/118 |
| 3,879,083 | 4/1975 | Olsson | 297/1 |
| 4,205,876 | 6/1980 | Cetina | 297/118 |
| 4,392,261 | 7/1983 | Ivory et al. | 5/101 |
| 5,016,301 | 5/1991 | Combs | 5/105 |

FOREIGN PATENT DOCUMENTS

| | | | |
|---|---|---|---|
| 172968 | 4/1952 | Austria | 297/119 |

*Primary Examiner*—F. Daniel Lopez
*Attorney, Agent, or Firm*—Pro-Techtor International

[57] ABSTRACT

A piece of multi-purpose furniture consisting of a pair of corresponding main frames, with one side of each of the main frames being contoured into an arc shape and another side being formed into a shape with a recessed contour, according to specifications. The inner side of each of the main frames is equipped with a multiple number of positioning slots of different sizes in accordance with specifications. A board for back rest, a board for seating, a board for auxiliary seating, a board for studying, a board for stepping, a board for sleeping, a set of protective boards and handling bars are inserted into the corresponding positioning slots, depending on the applications of the piece of multi-purpose furniture. In addition, a set of arc-shaped rocking bars are mounted onto the arc-shaped side of the two main frames. Accordingly, said multi-purpose furniture can be used as a dining chair, study chair, rocking chair and rocking crib, by changing the configurations of the different components.

4 Claims, 5 Drawing Sheets

PIECE OF MULT-PURPOSE FURNITURE

BACKGROUND AND SUMMARY OF THE INVENTION

The piece of multi-purpose furniture offered by the present invention can be used for different purposes. For example, said piece of multi-purpose furniture can be used as a dining chair, study chair, rocking chair, rocking crib, etc.

As commonly known, conventional infant dining chairs, study chairs, rocking chairs, rocking cribs, rockers, etc. are designed only to serve a single application, and furnishing a home with furniture for said utilizations would require purchasing several pieces of furniture, with each offering a different function. This method of furnishing a household is not desirable from the standpoint that buying several pieces of furniture requires a substantial monetary expenditure, and placing this considerable bulky furniture into a household leads to problems such as occupying valuable space and creating a cluttered impression.

In light of the problems described above, the inventor of the present invention conducted diligent research, taking into account infant ergonomics, and arrived at the present invention, which offers a piece of novel multi-purpose furniture that is economical, is practical and can be used for different purposes.

Specifically, said piece of multi-purpose furniture pertaining to the present invention is characterized by the fact that said piece of multi-purpose furniture consists of a pair of corresponding main frames, with one side of each of the main frames being contoured into an arc shape and another side being formed into a shape with a recessed contour, according to specifications. The inner side of each of the main frames is equipped with multiple number of positioning slots of different sizes in accordance with specifications. A board for a back rest is inserted into a positioning slot located near the arc-shaped side of said main frame. A board for seating is inserted into a positioning slot located at the lower end of said board for the back rest. A handle bar is inserted into a positioning slot located at each of the upper and lower ends of said main frame. A board for auxiliary seating is inserted into a positioning slot located vertically at a location near the middle of the assembly under said board for seating. A board for studying is inserted into a positioning slot located on the arc-shaped side of said main frame near the end of said board for auxiliary seating. A board for stepping is inserted in a positioning slot located at an appropriate position on the other side of said main frame, so that said piece of furniture can be used as a dining chair, study chair or playing chair when these components are assembled. Said piece of furniture can be formed into a rocking crib by removing the aforesaid boards, replacing them with a board for making a bed to be inserted into the positioning slots initially reserved for the boards for studying and back rest, inserting a protective board into each of the positioning slots on the two sides of said board for making a bed and mounting a set of arc-shaped rocking bars onto the arc-shaped side of said two main frames.

BEST MODE OF CARRYING OUT THE INVENTION

Figure 1:
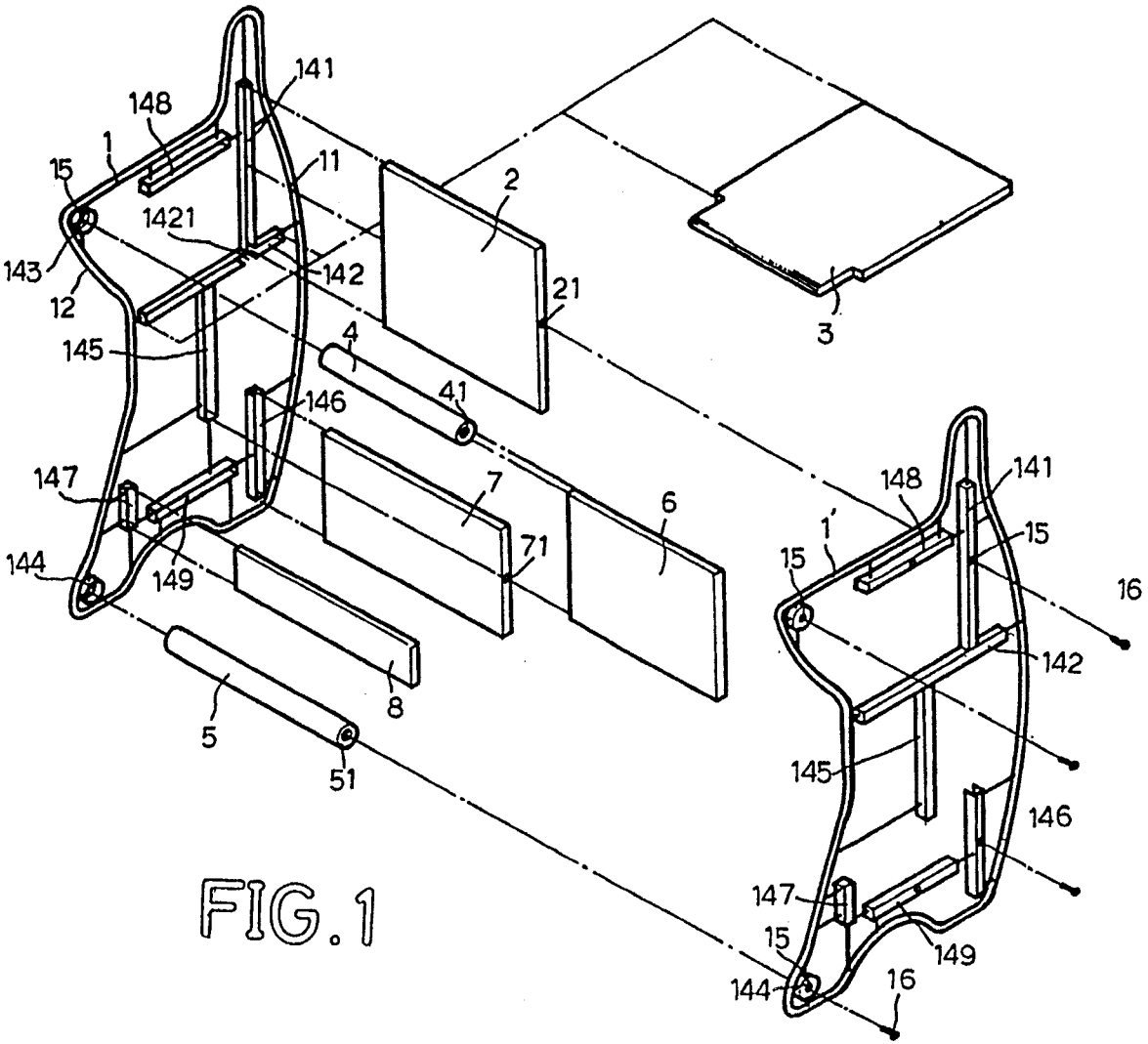
FIG. 1: A three-dimensional dissection drawing pertaining to Practical Example 1 of the present invention.

FIG. 1 is a three-dimensional dissection figure depicting the principal components pertaining to Practical Example 1 of the present invention. The figure shows that the piece of multi-purpose furniture pertaining to the present invention consists of a pair of main frames 1 and 1', board for back rest 2, board for seating 3, upper handle bar 4, lower handle bar 5, board for auxiliary seating 6, board for studying 7 and board for stepping 8. Said pair of main frames 1 and 1' are designed to correspond to each other, with one side of each of the main frames 1 and 1' being contoured into an arc-shaped side 11 and another side being formed into a recessed side 12, according to specifications. The inner side of each of the main frames 1 and 1' is equipped with a multiple number of positioning slots of different sizes in accordance with specifications. A positioning slot 141 for the board for back rest 2 is located near the arc-shaped side 11 of said main frame 1 or 1', and said board for back rest 2 is inserted into said positioning slot 141. A positioning slot 142 for the board for seating 3 is located at the lower side of said positioning slot 141, and the board for seating 3 is inserted into said positioning slot 142. In addition, an opening 1421 is formed at the junction between said positioning slots 142 and 141. A positioning slot 143 for the upper handle bar 4 is located at the upper part of the recessed side 12 of each of said main frames 1 and 1', as specified, and the upper handle bar 4 is inserted into said positioning slot 143. A positioning slot 144 for the lower handle bar 5 is located at the lower part of the recessed side 12 of each of said main frames 1 and 1', as specified, and the lower handle bar 5 is inserted into said positioning slot 144.

A positioning slot 145 for the board for auxiliary seating 6 is located at a location near the middle of the assembly under the aforesaid positioning slot 142, and the board for auxiliary seating 6 is inserted in said positioning slot 145. A positioning slot 146 for the board for studying 7 is located on the arc-shaped side 11 of each of said main frames 1 and 1', and the board for studying 7 is inserted into said positioning slot 146. A positioning slot 147 for the board for stepping 8 is located at an appropriate position on the other side of each of said main frames 1 and 1', and the board for stepping 8 is inserted into said positioning slot 147.

In order to assemble the aforesaid components and to facilitate the disassembling of these components for storage, said positioning slots 141, 143, 144 and 146 in said pair of main frames 1 and 1' are equipped with a sufficient number of tap holes 15 at various locations, and each end of said board for back rest 2 is equipped with a bolt hole 21. In addition, each end of said upper handle bar 4 is equipped with a bolt hole 41, each end of said lower handle bar 5 is equipped with a bolt hole 51, and each end of said board for studying 7 is equipped with a bolt hole 71. Screw bolts 16 are employed to fasten the aforesaid components during assembly of the piece of multi-purpose furniture pertaining to the present invention. Said piece of furniture can be disassembled by simply un-screwing said bolts 16, thereby minimizing the space needed to store said piece of furniture when not in use.

Figure 2:
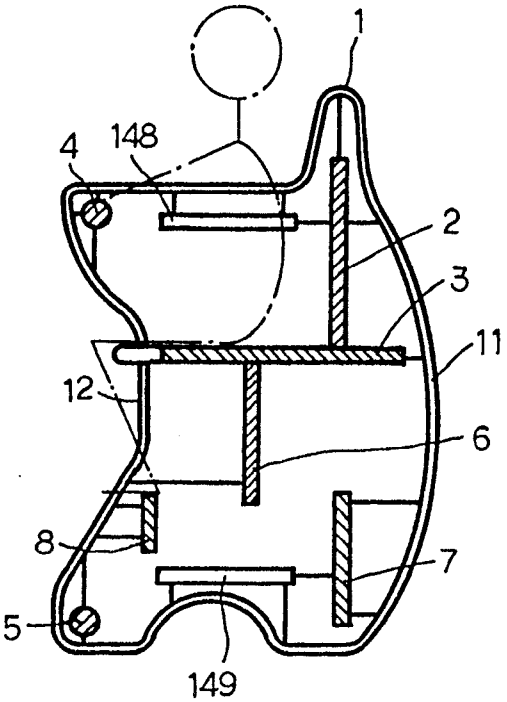
FIG. 2: A drawing showing an infant dining chair pertaining to Practical Example 1 of the present invention.

As shown in FIG. 2, when said pair of main frames 1 and 1' pertaining to the present invention is in a standing position, said piece of multi-purpose furniture pertaining to the present invention can be utilized as a dining chair by allowing the infant to sit on the seat formed by the board for back rest 2 and the board for seating 3, using said upper handle bar 4 as a grip, and utilizing said board for stepping 8 as a foot rest.

Figure 3:
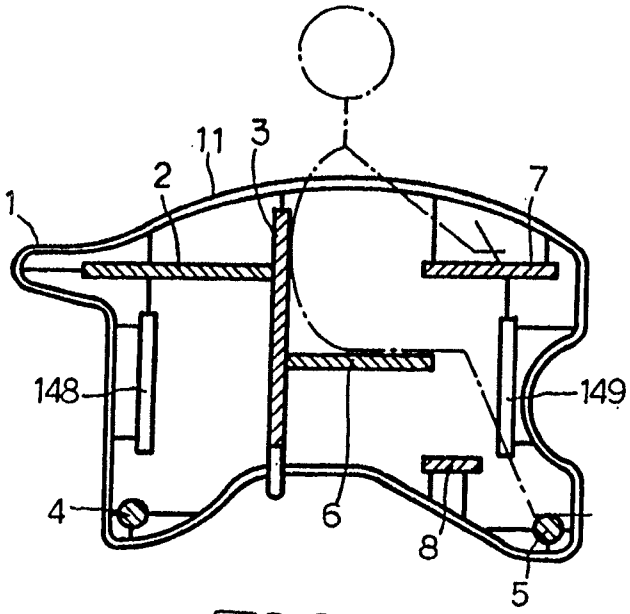
FIG. 3: A drawing showing an infant studying chair pertaining to Practical Example 1 of the present invention.

As shown in FIG. 3, when the arc-shaped side 11 of said pair of main frames 1 and 1' pertaining to the present invention faces upward and the recessed side 12 thereof faces downward, said piece of multi-purpose furniture pertaining to the present invention can be utilized as a study chair by allowing an infant to sit on the seat formed by the board for auxiliary seating 6 and the board for seating 3 and utilizing said board for studying 7 as a support for reading and writing.

Figure 4:
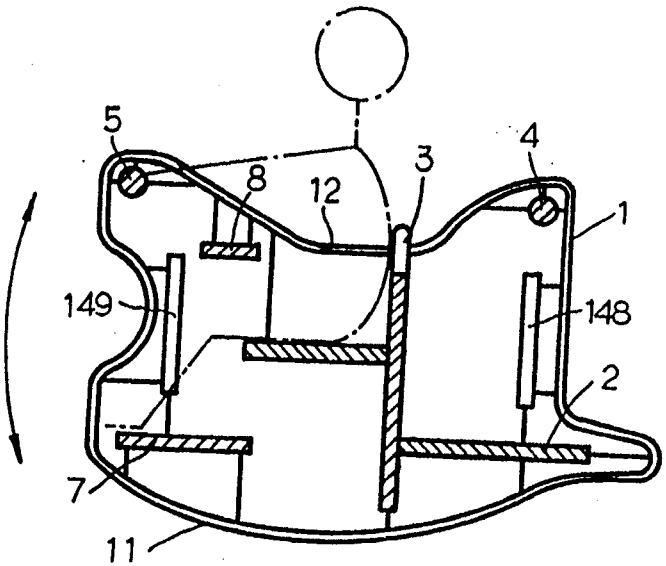
FIG. 4: A drawing showing an infant rocking chair pertaining to Practical Example 1 of the present invention.

As shown in FIG. 4, when the recessed side 12 of said pair of main frames 1 and 1' pertaining to the present invention faces upward and the arc-shaped side 11 thereof faces downward, said piece of multi-purpose furniture pertaining to the present invention can be utilized as a rocking chair by allowing an infant to sit on the seat formed by the board for auxiliary seating 6 and the board for seating 3, using said lower handle 5 as a grip, utilizing the back side of said board for studying 7 as a foot rest, and allowing said piece of multi-purpose furniture to rock in accordance with the contour of the arc-shaped side 11.

Figure 5:
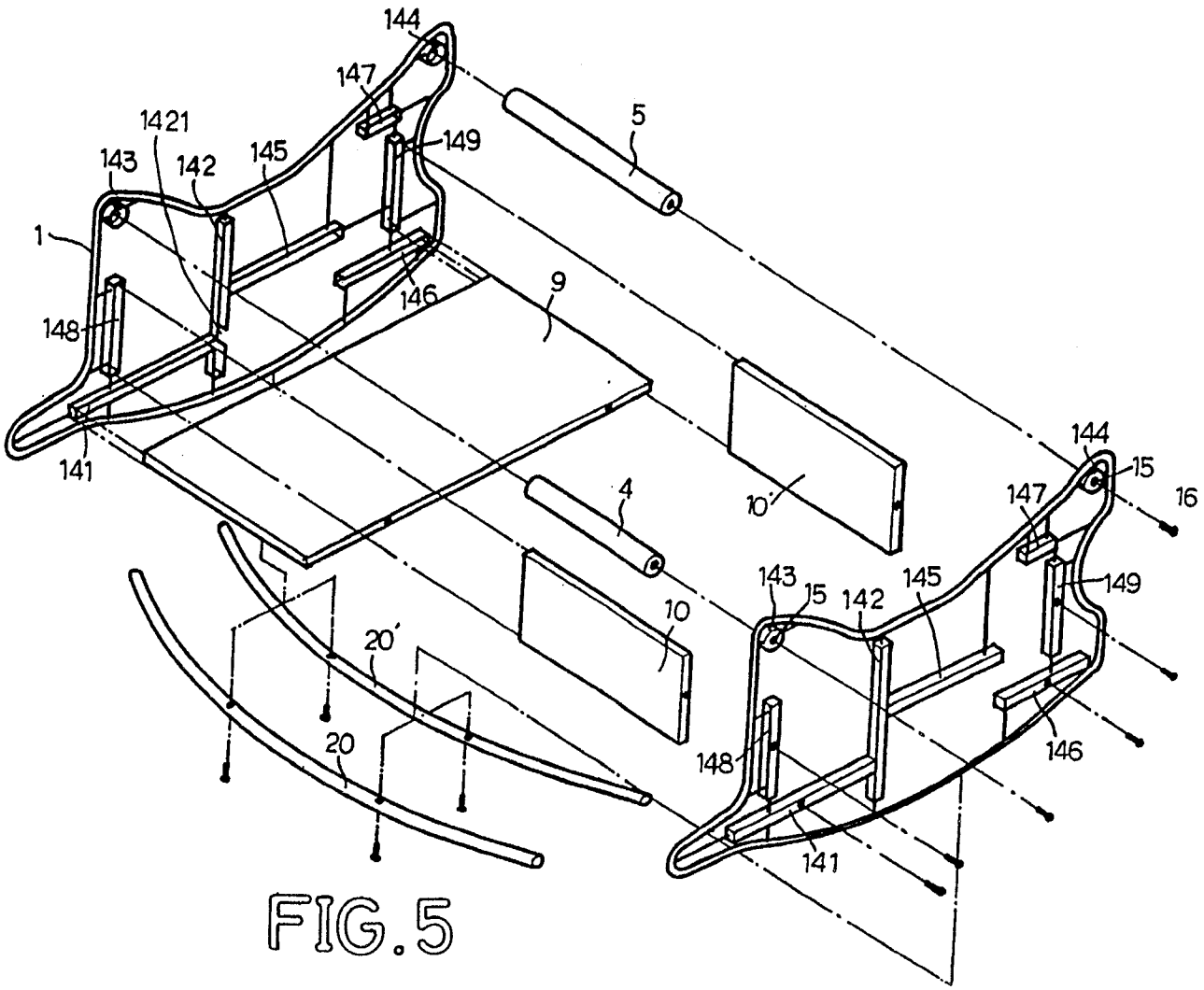
FIG. 5: A three-dimensional dissection drawing pertaining to Practical Example 2 of the present invention.
Figure 7:
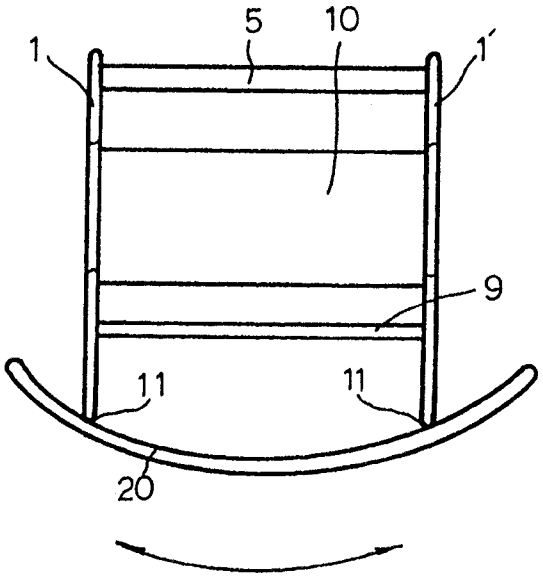
FIG. 7: Another view of the rocking crib pertaining to Practical Example 2 of the present invention.
Figure 6:
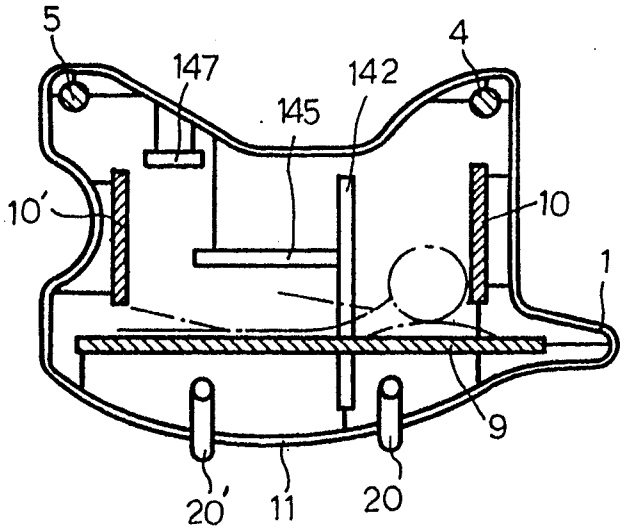
FIG. 6: A drawing showing a rocking crib pertaining to Practical Example 2 of the present invention.

FIG. 5 is a dissection drawing pertaining to Practical Example 2 of the present invention. A board for sleeping 9 is inserted into said positioning slot 146 for the board for studying 7 and said positioning slot 141 for the board of back rest 2. A set of positioning slots 148 and 149 for a set of protective boards is located on each side of said board for sleeping 9, and said protective boards 10 and 10' are inserted into said positioning slots 148 and 149. In addition, a set of corresponding arc-shaped rocking rods 20 and 20' are mounted onto the arc-shaped side 11 of said two main frames 1 and 1'. When the recessed side 12 of said pair of main frames 1 and 1' pertaining to the present invention faces upward and the arc-shaped side 11 thereof faces downward, said piece of multi-purpose furniture pertaining to the present invention can be utilized as a rocking crib, as shown in FIGS. 6 and 7.

In addition, said piece of multi-purpose furniture pertaining to the present invention is strengthened further by anchoring each of the aforesaid positioning slots onto the main frames 1 and 1' with steel rods and/or by means of direct fixation.

A described above, the piece of multi-purpose furniture pertaining to the present invention is of a novel and progressive design and possess practical values.

I claim:

1. A piece of multi-purpose furniture comprising:

a pair of corresponding main frames, wherein one side of each of the main frames is contoured into an arc shape and another side is recessed, an inner side of each of the main frames is equipped with multiple positioning slots of different sizes, a board for a back rest is inserted into positioning slots located near the arc-shaped sides of said main frames, a board for seating is inserted into positioning slots located at a lower end of said board for back rest, two handle bars are removably affixed to the main frames, an upper handle bar extending between two upper ends of said main frames and a lower handle bar extending between two lower ends of said main frames, a board for auxiliary seating is inserted into a positioning slot located near a center of said main frames under said board for seating, a board for studying is inserted into a positioning slot located on the arc-shaped sides of said main frames near an end of said board for auxiliary seating, and a board for stepping is inserted in positioning slots located on the recessed sides of the main frames; and wherein when a user desires to use the piece of furniture as a crib, said piece of furniture is disassembled, and a board for sleeping is inserted into positioning slots near the arc-shaped sides of said main frames, two protective boards are inserted into positioning slots at positions such that the protective boards are at ends of said board for sleeping and are perpendicular thereto, the handles bars are reinserted in their positions, and a set of arc-shaped rocking bars are mounted onto the arc-shaped side of said main frames.

2. The piece of multi-purpose furniture according to claim 1 wherein:

the main frames are positioned with said lower ends downward and said upper ends upward so that the piece of furniture is utilized as a dining chair, said board for seating forming a seat and said board for back rest forming a back rest, said upper handle forming a grip and said board for stepping forming a foot rest.

3. The piece of multi-purpose furniture according to claim 1 wherein:

said arc-shaped side of said main frames faces upward and said recessed side of said main frames faces downward so that the piece of furniture is utilized as a study chair, said board for auxiliary seating forming a seat, a first end of said board for seating forming a back rest, and said board for studying forming a support for reading and writing.

4. The piece of multi-purpose furniture according to claim 1 wherein:

said recessed side of said main frames faces upward and said arc-shaped side of said main frames faces downward so that the piece of furniture is utilized as a rocking chair, the board for auxiliary seating forming a seat, a second end of said board for seating forming a back rest, said lower handle forming a grip, said board for studying forming a foot rest, said piece of furniture rocking on said arc-shaped sides of said main frames.

* * * * *